US008602070B2

(12) United States Patent
Hansen

(10) Patent No.: US 8,602,070 B2
(45) Date of Patent: Dec. 10, 2013

(54) DEVICE FOR FILLING CONTAINERS

(76) Inventor: Bernd Hansen, Sulzbach-Laufen (DE)

( * ) Notice: Subject to any disclaimer, the term of this patent is extended or adjusted under 35 U.S.C. 154(b) by 353 days.

(21) Appl. No.: 12/736,594

(22) PCT Filed: May 26, 2009

(86) PCT No.: PCT/EP2009/003706
§ 371 (c)(1),
(2), (4) Date: Oct. 21, 2010

(87) PCT Pub. No.: WO2009/152926
PCT Pub. Date: Dec. 23, 2009

(65) Prior Publication Data

US 2012/0018038 A1 Jan. 26, 2012

(30) Foreign Application Priority Data

Jun. 17, 2008 (DE) ..... 10 2008 028 772

(51) Int. Cl.
*B65B 3/04* (2006.01)

(52) U.S. Cl.
USPC ..... 141/117; 141/119; 141/236; 141/244; 141/311 A

(58) Field of Classification Search
USPC ..... 141/115–117, 119, 236, 242–244, 311 A
See application file for complete search history.

(56) References Cited

U.S. PATENT DOCUMENTS 3,670,787 A * 6/1972 Hansen ..... 141/250
4,394,945 A * 7/1983 Taylor, Jr. ..... 141/117
4,619,589 A * 10/1986 Muller et al. ..... 417/388
4,621,747 A * 11/1986 van der Velde et al. ..... 141/261
5,016,687 A * 5/1991 Kawamura ..... 141/116
5,019,127 A * 5/1991 Bohm et al. ..... 141/258
5,193,593 A 3/1993 Denis et al.
5,255,720 A * 10/1993 McPherson ..... 141/115
5,437,316 A * 8/1995 McPherson ..... 141/115
6,065,940 A * 5/2000 Fleischer et al. ..... 417/63
7,445,163 B2 * 11/2008 Fukano et al. ..... 222/571
2005/0006609 A1 1/2005 Fukano

FOREIGN PATENT DOCUMENTS

DE 21 07 647 A 9/1972
DE 25 28 975 A1 1/1977
DE 39 21 791 C1 5/1990
EP 0 418 080 B1 11/1993

* cited by examiner

*Primary Examiner* — Timothy L Maust
*Assistant Examiner* — Nicolas A Arnett
(74) *Attorney, Agent, or Firm* — Roylance, Abrams, Berdo and Goodman LLP

(57) ABSTRACT

A device for filling containers includes an arrangement (7) for feeding filling material to at least one dosing system (5) forming a flow path (27) containing a dosing valve (29) that can be opened at least for the duration of the dosing processes to distribute the dosing amounts of the filling material via at least one filling line (9) into relevant containers. The dosing system (5) has an element (31, 33, 43) disposed in the flow path (27) downstream of the dosing valve (29) for selectively producing a suction effect in the flow path (27). A control mechanism (39) activates the element (31, 33, 43) producing the suction effect. Dosing processes are completed by closing the dosing valve (29).

12 Claims, 4 Drawing Sheets

DEVICE FOR FILLING CONTAINERS

FIELD OF THE INVENTION

The invention relates to a device for filling containers, comprising an arrangement for feeding filling material to at least one dosing system forming a flow path in which there is a dosing valve. The dosing valve can be opened at least for the duration of the dosing processes to deliver the dosing amounts of the filling material to the pertinent containers by at least one filling line.

BACKGROUND OF THE INVENTION

In the pertinent prior art, a system economically enabling automated molding (blow molding or vacuum molding), filling, and sealing of containers is known under the trademark Bottelpack®. When the containers are to be filled with sensitive products, for example, pharmaceuticals, the international standards for aseptic packaging must be satisfied and during each filling process a specific dosing amount must be filled in each container. The quantity of the filling amount must be maintained with the greatest precision, especially when highly efficacious pharmaceuticals are involved.

To meet these requirements, in a device disclosed in document EP 0 418 080 B1, for each filling line assigned to a pertinent container to be filled, a dosing valve opens and closes in a time-controlled manner by electromagnetic actuation. The opening time for each dosing process is chosen such that at a set buffer pressure of the filling material is available in a dosing distributor. The desired dosing amount flows through the dosing valve during the opening time.

SUMMARY OF THE INVENTION

An object of the invention is to provide an improved filling device of the aforementioned type which is characterized by increased dosing accuracy compared to the prior art.

This object is basically achieved according to the invention by a device where, downstream of the dosing valve, a control is provided by which a suction action can be produced on the flow path when the respective dosing processes are completed. Specifically, the suction action is produced when the pertinent dosing valve closes. When the dosing process is ended, in the filling line, this suction action causes return suction of the remaining liquid out of the filling line or at least prevents dripping of liquid afterwards. A maximum of dosing accuracy certainly can be achieved in this way.

In advantageous exemplary embodiments, between the dosing valve and the filling line a choke site constricts the flow path during the dosing processes, In the region of the choke site, a movable control element defines the width of the flow path depending on its position setting and can be transferred into a position which widens the flow path at the choke site by forming a bypass when the suction device is activated. The choke site interacts with the time control of the opening time of the dosing valve to determine the dosing amount. In interaction with the control element defining the width of the flow path, the choke site also forms a part of the suction action device having an operating principle of the movable control element forms a widening in the flow path as a bypass of the choke site. This arrangement results in an enlargement of the inside volume of the flow path, and thus in an afterflow effect.

Advantageously, the suction action device is formed by a bypass valve being a diaphragm valve whose diaphragm forms the movable control element. One closing side of the control element delimits the flow path at the choke site. On the other control side of the control element, a negative pressure can be applied for producing a suction action to cause the diaphragm to execute a deflection motion which widens the flow path. This lift of the diaphragm produces the suction action on the filling line. In these exemplary embodiments the means which produces the suction action device is characterized by an especially simple construction.

The dosing valve can also be formed by a diaphragm valve in a correspondingly advantageous manner.

An especially compact and simple structure of the dosing system can be achieved when the dosing valve and the downstream bypass valve are diaphragm valves controlled by a joint diaphragm extending along the flow path.

To support the movement of the diaphragm both at the dosing valve and at the bypass valve into the rest position, i.e., into the respective closed position, and to elicit deflection movements out of the rest position, on the control side of the diaphragm opposite the closing side alternately an overpressure as the closing pressure and an underpressure as the opening pressure can be applied to the pertinent dosing valve and to the pertinent bypass valve by assigned control lines.

Advantageously, a plurality of filling lines have respectively assigned dosing units combined in a dosing block. The input sides of the respective dosing valves are connected to a common distributor of the filling material under a set buffer pressure.

In such design, in the dosing block, a diaphragm is assigned to the dosing valves and bypass valves and is common to the dosing system as a whole.

In operation with this dosing block, the diaphragm can be triggered jointly on the bypass valves from a common control line, while for the control sides of the diaphragm on the dosing valves, each filling line has its own control line for pressure and negative pressure.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
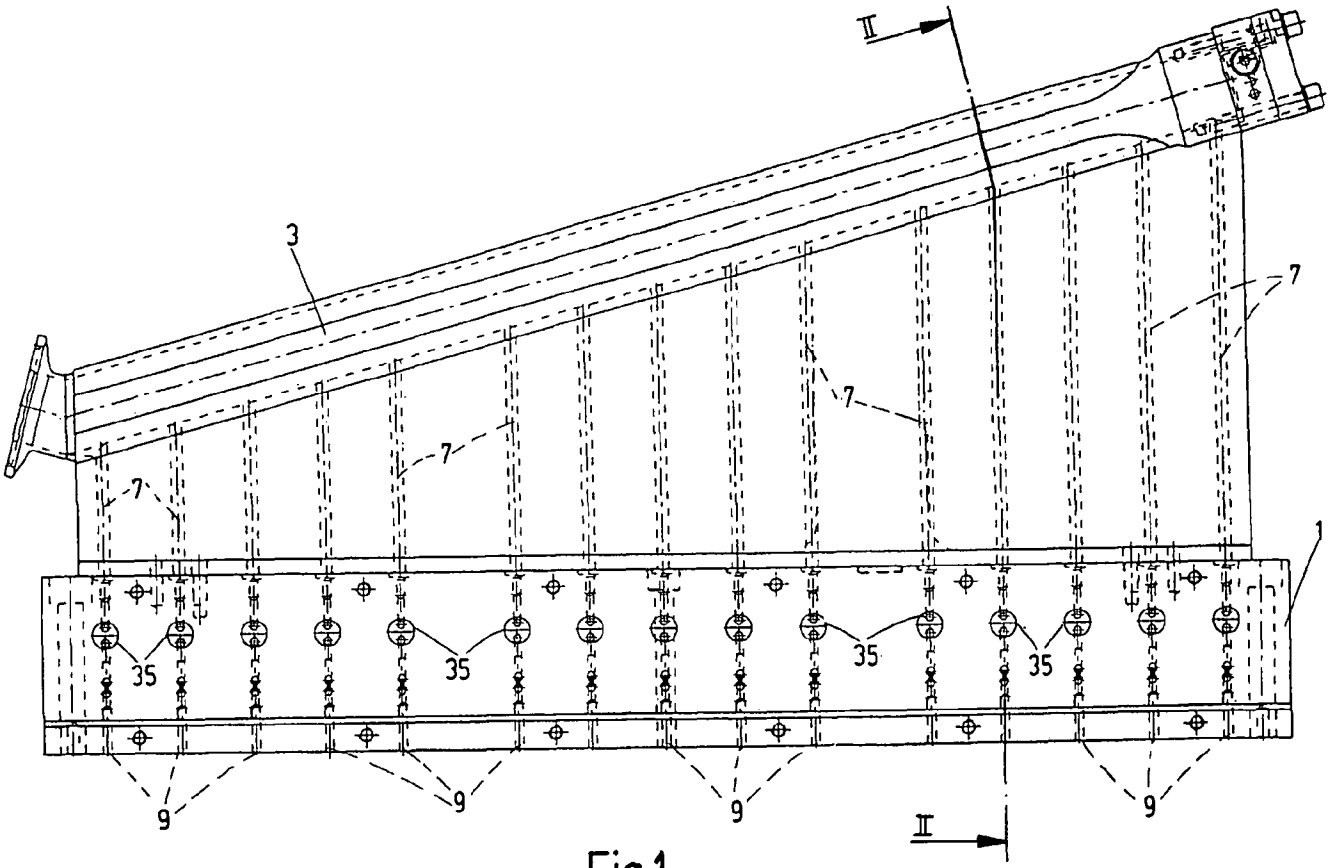
FIG. 1 is a side elevational view of only the dosing block with the pertinent distributor of filling material of a device according to an exemplary embodiment of the invention, which view is approximately half-size compared to a practical embodiment.

The invention is explained below using one example in which the device contains a plurality of dosing systems. Specifically according to FIG. 1, fifteen dosing systems 5 are combined in a common dosing block 1. From a common distributor of filling material 3 in which the liquid to be filled in is under a set buffer pressure, each of the dosing systems 5 within the dosing block 1 receives the liquid filling material via a feed line 7, only a few of these lines are numbered in FIG. 1. In the course of operation, the dosing systems 5 deliver the dosing amounts to a corresponding filling line 9 (likewise not all numbered in FIG. 1). Each filling line 9 leads to a device (not shown) in FIG. 1, for producing and filling containers, for example, a device according to the known Bottelpack® system.

Figure 3:
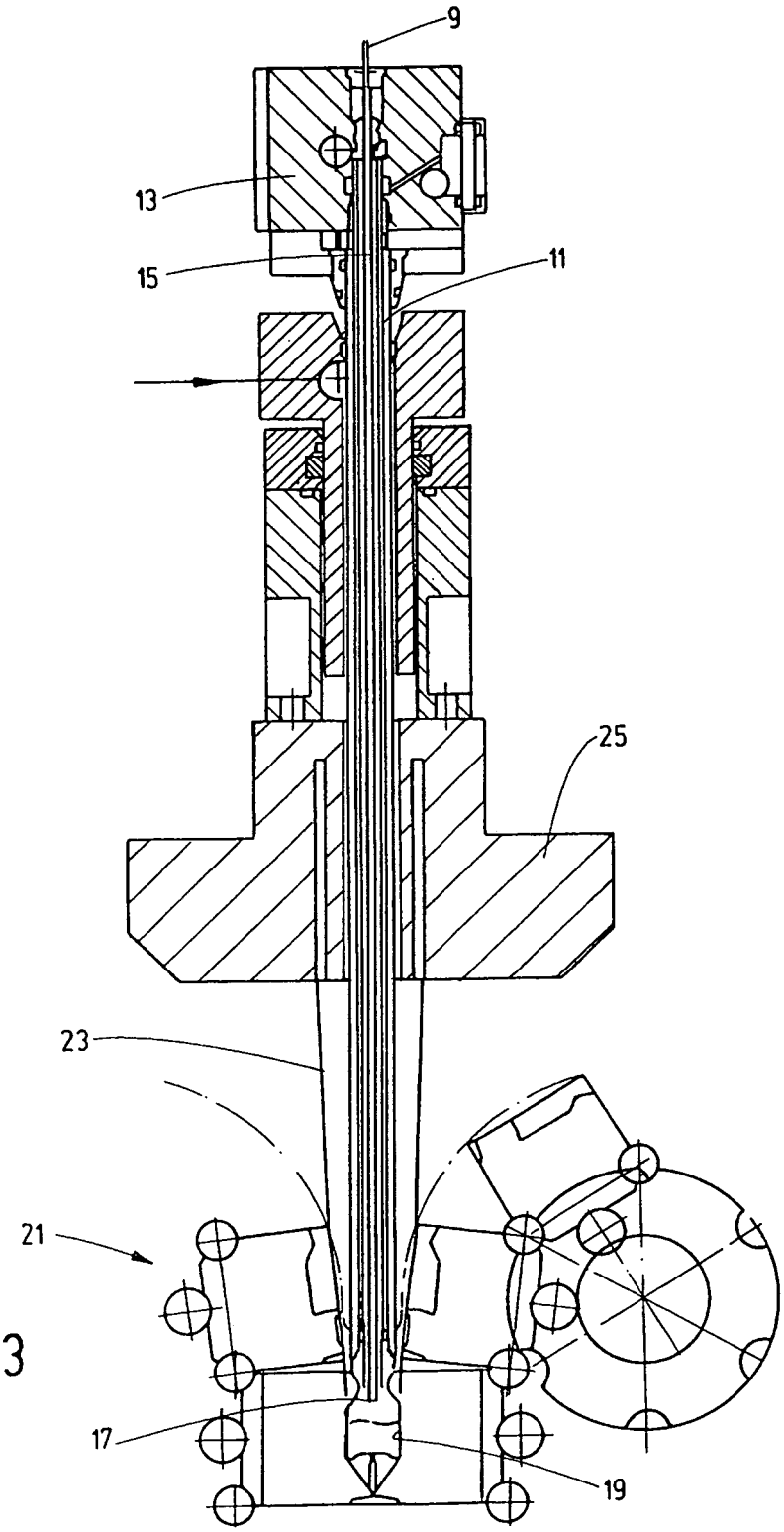
FIG. 3 is a schematically simplified, end elevational view in section of a device for producing and filling containers, one filling line being shown which is connected to the pertinent filling line output of the dosing block of in FIGS. 1 and 2.

Of this device, only FIG. 3 schematically shows a production and filling unit. As is apparent from this figure, each of these systems has a filling mandrel 11 on whose end, which is at the top in the figure, there is a supply head 13 for supply of channels in the filling mandrel 11 with media. As FIG. 3 shows, on the supply head 13 the pertinent filling line 9 is connected to a filling material channel 15 extending centrally in the filling mandrel 11. The filling material supplied, dosed by the respective filling lines 9, emerges on the lower, fill needle-shaped end 17 of the filling mandrel 11 for filling of a respective container 19. Container 19 is formed in a forming device 21 according to the aforementioned Bottelpack® system from plastic tubing 23 produced by an extruder head 25 from plasticized plastic material.

Figure 2:
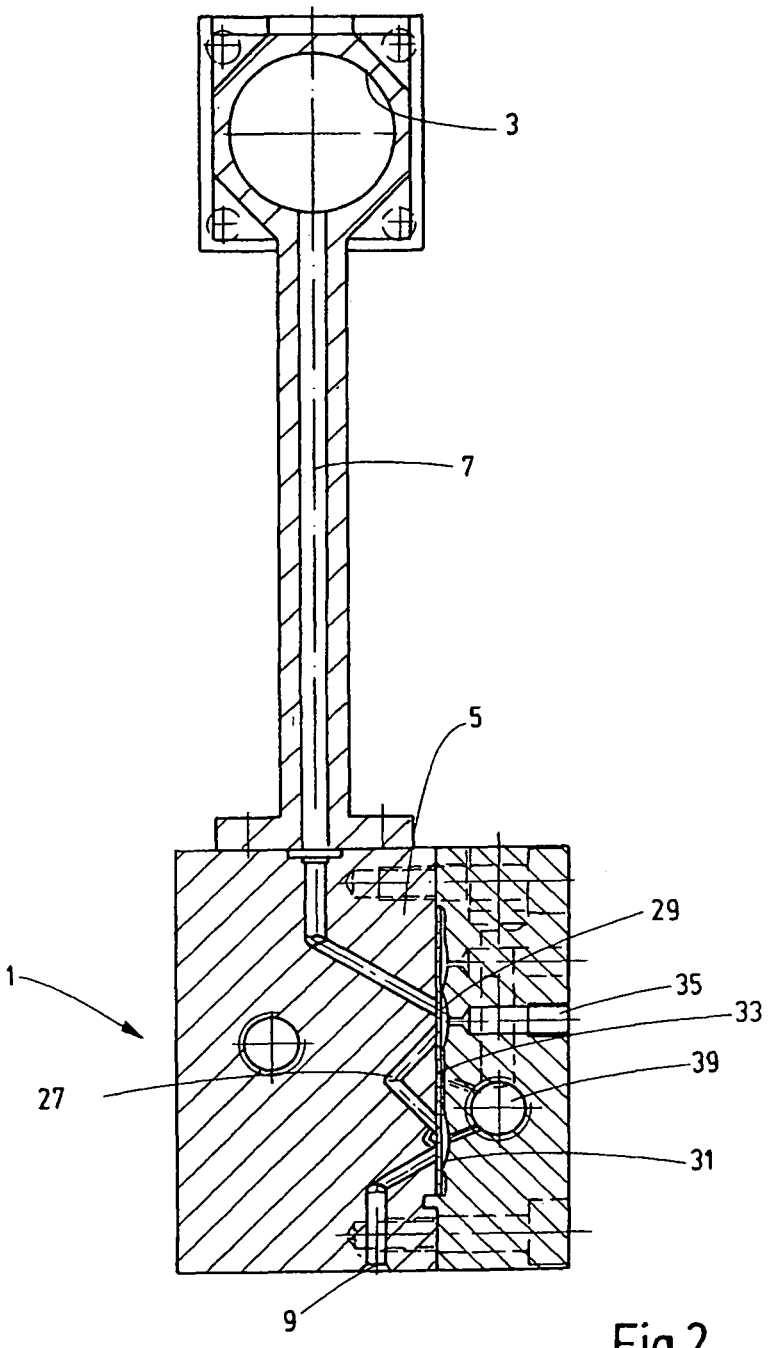
FIG. 2 an end elevational view in section enlarged compared to FIG. 1 and taken along line II-II of FIG. 1.

FIGS. 2 and 4 show details of the dosing units 5 combined in the dosing block 1. As is apparent, on a flow path 27 extending between the feed line 7 and filling line 9, two valves are connected in succession, specifically an upstream dosing valve 29 and a bypass valve 31 conversely located downstream. Both valves are diaphragm valves with a diaphragm 33 pneumatically controlled for deflection and resetting movements. The diaphragm 33, preferably made from a plastic material such as PTFE or a rubber material, is common to both valves 29 and 31 of a dosing system 5, and also common to all dosing systems 5 contained in the dosing block 1; i.e., the diaphragm 33 extends over the longitudinal area of the dosing block 1. Each dosing valve 29 has its own pneumatic connection 35 for individual application of positive pressure or negative pressure to the control side 37 on the respective dosing valve 29. In FIG. 1 not all of the pneumatic connections 35 are numbered. The bypass valves 31 all have a pneumatic connection 39, which is common to them to apply a positive pressure or a negative pressure to the control side 37 of the diaphragm 33 on the respective bypass valve 21.

Figure 4A:
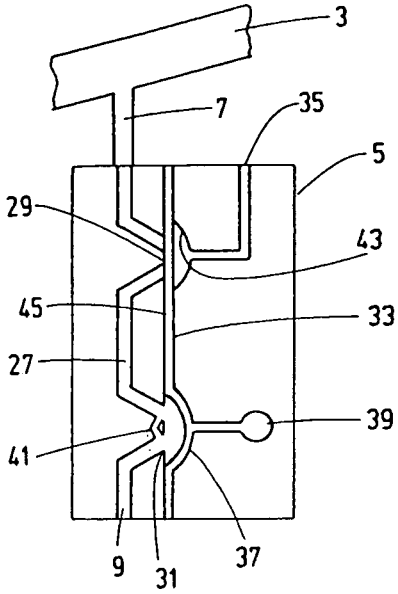
FIGS. 4*a* to 4*d* are schematic end elevational views illustrating the construction and manner of operation of the dosing valve according to the exemplary embodiment of the invention.
Figure 4B:
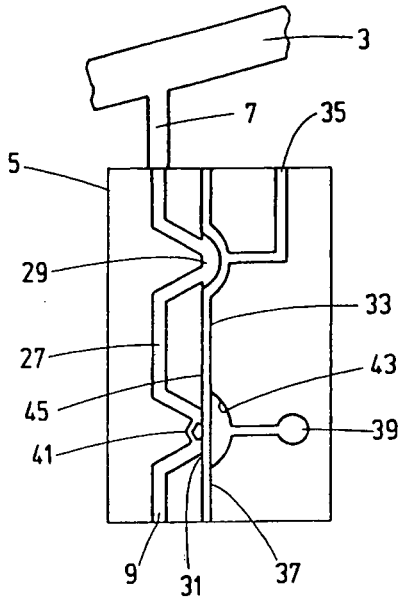
Figure 4C:
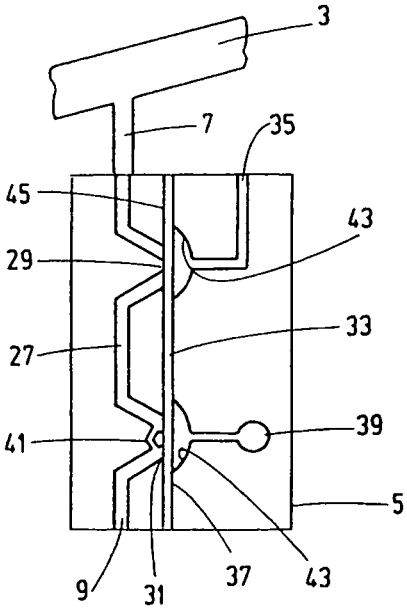

FIGS. 4*a* to 4*d* best illustrate how the dosing systems 5 work. As shown, on the dosing valve 29 and bypass valve 31 on the control side 37 of the diaphragm 33 there is a spherical cap-shaped space 43 into which a surface region of the diaphragm 33 can be deflected when negative pressure is applied to the control side 37 by the pneumatic connections 35 or 39. The opposite closing side 45 of the diaphragm 33 is raised out of the closed position and deflected into the respective space 43 by the negative measure. This deflection causes opening of the pertinent valve 29 or 31. FIG. 4*a* shows the dosing valve 29 in the closed position, while the bypass valve 31 is opened. FIG. 4*b* shows the dosing valve 29 open, while the bypass valve 31 is closed. FIG. 4*c* shows both valves 29 and 31 in the closed position, while FIG. 4*d* in turn shows the dosing valve 29 closed and the bypass valve 31 open. On the bypass valve 31 there is a respective choke site 41 on the flow path 27. FIG. 4*a* shows the rest position of the system prior to the respective dosing process, the dosing valve 29 still being closed while the bypass valve 31 is in the open position. In this open position of the bypass valve 31 in which the diaphragm 33 is deflected into the spherical cap-shaped space 43, the flow path 27 is significantly widened compared to the state with the bypass valve 31 closed according to the volume of the respective chamber 43. With the bypass valve 31 open, passage not only via the choke site 41 is thus available to the flow path. FIG. 4*b* illustrates the dosing process in which the dosing valve 29 is opened, while the bypass valve 31 is closed so that the size of the passage of the choke site 41 in conjunction with the time-controlled length of opening of the dosing valve 29 determines the dosing amount.

Figure 4D:
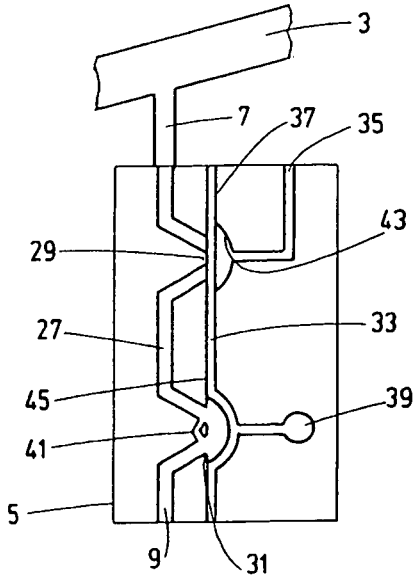

FIGS. 4*c* and 4*d* illustrate the completion of the dosing process by closing of the dosing valve 29 (FIG. 4*c*). After completed closing of the dosing valve 29, the bypass valve 31 is opened as shown in FIG. 4*d*. The corresponding deflection motion of the diaphragm 33 into the spherical cap-shaped space 43 leads to a considerable widening of the flow path 27 at the bypass valve 31. This lifting motion of the diaphragm 33 with the dosing valve 29 closed produces a suction action which causes return suction of liquid from the downstream filling line 9.

As already mentioned, the dosing amount is determined by time control of the duration of opening of the respective dosing valve 29 via the individual pneumatic connection 35. The suction action on the filling lines 9 can be produced simultaneously for all dosing systems 5 by the pneumatic connection 39 which is common to them being triggered.

For conventional cleaning and sterilization measures as are carried out conventionally before the start of the production phases, the dosing valves 29 and the bypass valves 31 are controlled into the open position. Thus, the unchoked flow path 27 is available for throughflow of cleaning and sterilization media, originating from the distributor of filling material 3 via the feed line 7, dosing system 5, and filling line 9 to the filling material channel 15 of the pertinent filling mandrel 11.

While one embodiment has been chosen to illustrate the invention, it will be understood by those skilled in the art that various changes and modifications can be made therein without departing from the scope of the invention as defined in the appended claims.

What is claimed is:

1. A device for filling containers, comprising:

a filling material feeder;

at least one dosing system connected to said feeder to receive filling material therefrom, said dosing system having a flow path with a dosing valve therein, said dosing valve being openable at least for a duration of a dosing process to deliver dosing amounts of filling material to containers via at least one filling line;

a bypass diaphragm valve in said flow path downstream of said dosing valve for optionally producing a suction action on said flow path and through said filling line, said bypass diaphragm valve having a diaphragm forming a movable control element with opposite first and second control sides;

a control activating said bypass diaphragm valve depending on dosing processes ended by closing of said dosing valve; and a choke site between said dosing valve and said filling line constricting said flow path during the dosing processes, said movable control element being in a region of said choke site and defining a width of said flow path depending on position settings, said movable control element being transferable by deflection thereof to an open position widening said flow path at said choke site by forming a bypass of the choke site to produce the suction action upon application of a negative pressure to said second control side of said moveable control element and being transferable to a closed position with said first control side delimiting the flow path through said choke site.

2. A device according to claim 1 wherein said dosing valve comprises a dosing diaphragm valve.

3. A device according to claim 2 wherein said diaphragm of said bypass diaphragm valve also forms a diaphragm of said dosing diaphragm valve and extends along said flow path.

4. A device according to claim 3 wherein said second control side is alternatively exposed to an overpressure to close said bypass diaphragm valve and an underpressure to open said bypass diaphragm valve via respective control lines.

5. A device for filling containers, comprising:

a filling material feeder;

a plurality of dosing systems combined in a dosing block and connected to said feeder to receive filling material therefrom, each said dosing system having a flow path with a dosing valve being openable at least for a duration of a dosing process to deliver dosing amounts of filling material to container via a respective filling line, input sides of said dosing valves being connected to a common distributor of filling material under a set buffer pressure;

a suction device in each said flow path downstream of the respective dosing valve optionally producing a suction action on said flow path and having a bypass valve;

a control activating each said suction device to produce the suction action depending on dosing processes ending by closing the respective dosing valve; and a block diaphragm in said dosing block being common to said dosing valves and said bypass valves of said suction devices.

6. A device according to claim 5 wherein said block diaphragm comprises a control side, the respective dosing valve for each said filling line having respective control lines for positive pressure and negative pressure connected to said control side.

7. A device according to claim 6 wherein a common line of said control applies negative pressure for simultaneous activation of each said bypass valve on said control side of said block diaphragm.

8. A device according to claim 5 wherein a choke site is between each said dosing valve and the respective filling line and constricts the respective flow path during dosing processes;

each said bypass valve comprises a movable control element formed by a portion of said block diaphragm in a region of the respective choke site to define a width of the respective flow path depending on a position setting thereof and is transferable to a position widening the respective flow path at the respective choke site by forming a bypass when the respective suction device is activated.

9. A device according to claim 8 wherein each said bypass valve comprises a bypass diaphragm valve with said diaphragm thereof forming the respective movable control element with opposite first and second control sides, each said diaphragm being transferable by deflection thereof to an open position thereof widening the respective flow path at the respective choke site to produce the suction action upon application of a negative pressure to said second control side thereof and being transferrable to a closed position with said first control side thereof delimiting the respective flow path through the respective choke site.

10. A device according to claim 9 wherein each said dosing valve comprises a dosing diaphragm formed by a portion of said block diaphragm.

11. A device according to claim 10 wherein said block diaphragm extends along each said flow path.

12. A device according to claim 11 wherein each said second control side is alternatively exposed to an overpressure to close the respective bypass diaphragm valve and an underpressure to open the respective bypass diaphragm valve via respective control lines.

* * * * *